US006444416B1

(12) United States Patent
Qiao et al.

(10) Patent No.: US 6,444,416 B1
(45) Date of Patent: Sep. 3, 2002

(54) COLOR PHOTOGRAPHIC ELEMENT WITH IMPROVED DEVELOPABILITY

(75) Inventors: Tiecheng A. Qiao, Webster; Daniel L. Kapp, Rochester; Yongcai Wang, Webster, all of NY (US); Peter J. Twist, Bucks (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/740,225

(22) Filed: Dec. 19, 2000

(51) Int. Cl.[7] ..... G03C 1/047; G03C 1/04; G03C 1/76

(52) U.S. Cl. ..... 430/531; 430/206; 430/404; 430/537; 430/539; 430/628; 430/642; 430/963

(58) Field of Search ..... 430/206, 404, 430/537, 539, 628, 963, 531, 642

(56) References Cited

U.S. PATENT DOCUMENTS

| | | | | | |
|---|---|---|---|---|---|
| 3,791,831 | A | * | 2/1974 | Bonin et al. | 430/529 |
| 5,066,563 | A | * | 11/1991 | Aono et al. | 430/404 |
| 5,302,501 | A | * | 4/1994 | Tamura et al. | 430/628 |
| 5,445,931 | A | * | 8/1995 | Yamanouchi et al. | 430/537 |
| 5,753,422 | A | | 5/1998 | Shibahara et al. | 430/627 |
| 5,928,847 | A | | 7/1999 | Visconte et al. | 430/507 |
| 5,958,660 | A | * | 9/1999 | Taylor et al. | 430/537 |

* cited by examiner

*Primary Examiner*—Richard L. Schilling
(74) *Attorney, Agent, or Firm*—Sarah Meeks Roberts

(57) ABSTRACT

This invention relates to a silver halide photographic element comprising a support and at least one gelatin containing imaging or non-imaging layer wherein during chemical processing the maximum swell of the layer is greater than the equilibrium swell.

21 Claims, 1 Drawing Sheet

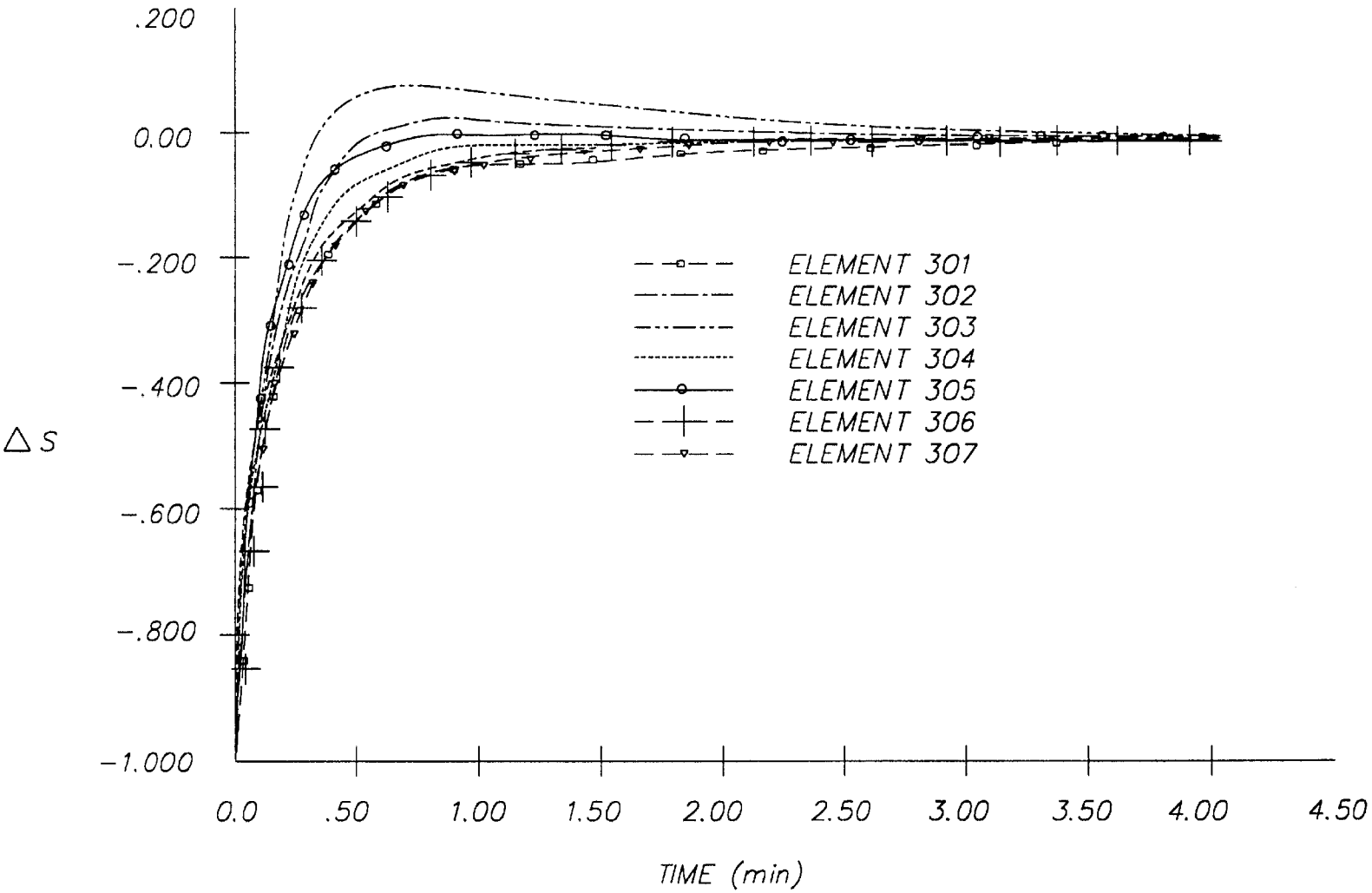
ELEMENT 301
ELEMENT 302
ELEMENT 303
ELEMENT 304
ELEMENT 305
ELEMENT 306
ELEMENT 307
.200
0.00
-.200
-.400
-.600
-.800
-1.000
ΔS
0.0
.50
1.00
1.50
2.00
2.50
3.00
3.50
4.00
4.50
TIME (min)

COLOR PHOTOGRAPHIC ELEMENT WITH IMPROVED DEVELOPABILITY

FIELD OF THE INVENTION

The present invention relates to a silver halide color photographic material with improved developability. In particular it relates to a silver halide color photographic element that contains a water soluble polymeric addenda.

BACKGROUND OF THE INVENTION

Silver halide photographic elements are typically exposed to suitable radiation to form a latent image. The latent image formed during exposure is amplified through a chemical development process to form a visible dye image. To form a color image, the exposed photographic elements are carried through a developer solution in which a color developing agent reduces developable silver halide to metallic silver and forms oxidized developer which in turn reacts with coupler to generate image dye. This step is generally followed by a bleaching or bleach/fixing step where the metallic silver is bleached and removed out of the gelatin binder. Finally a rinsing step is required to clean residual amounts of chemicals out of the photographic element. This photographic development process can take as long as five to fifteen minutes for a silver bromide based photographic material and as long as three to eight minutes for a silver chloride based photographic material.

In recent years, there has been great interest in accelerating the photographic process, that is, to shorten the time necessary for developing a silver halide color photographic material. A great deal of progress has been made in reformulating color photographic processing solutions and conditions including such changes as increasing developer concentration, lowering development restrainer concentration, and increasing temperature and pH. An alternative way of accelerating the photographic process, however, is to modify the photographic material itself to make it more developable. A readily developable color photographic element is desirable not only for rapid photographic processing but also for conventional photographic processing. Such a photographic element would be very robust with regard to color reproduction and density fluctuation, particularly in the higher density regions which normally take a longer time to develop.

Typically, a silver halide based photographic element consists of three imaging layers: a cyan layer, which contains a silver halide emulsion sensitized with a red responsive sensitizing dye; a magenta layer, which contains a silver halide emulsion sensitized with a green responsive sensitizing dye; and a yellow layer, which contains a silver halide emulsion sensitized with blue responsive sensitizing dye. The sensitized emulsions are dispersed in a hydrophilic gelatin matrix, which also contains color formation couplers. In the multilayer photographic elements used in color photography there are also interlayers between each imaging layer to control the random migration of oxidized developer, thereby preventing color contamination. In a color negative film or a color paper print format, the multilayer structure requires that one imaging layer of the three be located at the bottom of the pack. Thus, the bottom layer is always the last imaging layer to be developed and the most challenging to be developed.

Efforts have been made to improve the developability of the color photographic element itself. U.S. Pat. No. 5,753,422, discloses a method of improving sharpness, graininess, and push-processing by using anionic water soluble polymer addenda. U.S. Pat. No. 5,928,847, describes photographic elements with improved sensitometric properties that use ultrathin tabular grain emulsions having well balanced water swelling values in each dye-forming layer.

Despite efforts in this area, however, the need still exists for a multilayer, multicolor photographic element that has readily developable characteristics and improved sensitometric performance when processed under rapid processing conditions.

SUMMARY OF THE INVENTION

This invention provides a silver halide photographic element comprising a support and at least one gelatin containing imaging or non-imaging layer wherein during chemical processing the maximum swell of the layer is greater than the equilibrium swell. This invention further provides a silver halide photographic element comprising a support and at least one gelatin containing imaging or non-imaging layer containing a water-soluble polymeric acid.

The photographic elements of this invention have improved developability without sacrificing sensitometric performance. This is particularly advantageous in the imaging layer nearest the support which is traditionally the limiting factor in the development process.

BRIEF DESCRIPTION OF THE DRAWINGS

The FIGURE depicts the ΔSwell for Samples 301 to 307.

DESCRIPTION OF PREFERRED EMBODIMENTS

In one embodiment the silver halide photographic elements of this invention comprise a support and at least one gelatin containing imaging or non-imaging layer wherein during chemical processing the maximum swell of the layer is greater than the equilibrium swell. The term "maximum swell" of the gelatin containing layer is the point during the development step of chemical processing that the swell of the gelatin layer is the greatest. The term "equilibrium swell" is known to those skilled in the art and is the point during the development step at which the swell of the gelatin layer is neither increasing or decreasing. The methods for measuring swell are known to those skilled in the art and may be found in *Green and Levenson, J. Photogr. Sci. Vol.* 20, 1972.

A gelatin containing layer with a maximum swell greater than the equilibrium swell allows the developing solution to diffuse through the layer at a greater rate, thus improving the development speed. The equilibrium swell of many photographic elements has been pushed to the limit, thus the option of generally increasing the equilibrium swell is unavailable for many materials. Further, by increasing the maximum swell instead of the equilibrium swell, the amount of liquid material carried over between processing steps and the amount of water to be removed in the drying step does not increase. In one particularly useful embodiment the gel containing imaging or non-imaging layer is a layer above the imaging layer closest to the support. This placement allows the developer to more easily diffuse to said imaging layer.

In one embodiment of this invention wherein the maximum swell of the gelatin containing layer is greater than the equilibrium swell, the gelatin containing layer contains a swell enhancing compound which will wash out during chemical processing. Such a swell enhancing compound must be water soluble and it must be compatible with the gelatin matrix.

One suitable class of swell enhancing compounds is water-soluble polymeric acids. Preferably the water soluble polymeric acid is one which can be readily dissolved in water in the amount of at least one g/L at 25° C. Preferably the water-soluble polymeric acid has a molecular weight of about 500 to about 15000 Daltons. The water soluble polymeric acid may be used in any effective amount, it is preferred, however, that the water soluble polymeric acid be contained in the gelatin containing layer in an amount of about 5% to about 20% of the gelatin in the layer.

More preferably the water-soluble polymeric acid is represented by Formula I.

Formula I

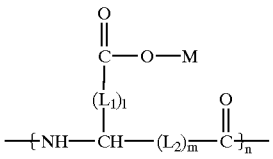

M is H or a metal cation. n is greater than 10 and preferably greater than 50. Preferably n is less than 1000 although n may be any value which provides a compound which is practically useful in a silver halide element and which does not affect solubility. $L_1$ and $L_2$ are divalent linking groups and m and 1 are independently 0 or 1. Preferably $L_1$ and $L_2$ are independently one or more (i.e. two or more of the following groups linked together) of a carbon atom, an oxygen atom, a sulfur atom, a carbonyl group

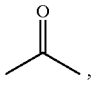

a carboxylic ester group

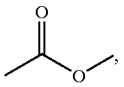

a carboxylic amide group

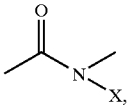

a sulfonyl group

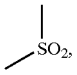

a sulfonamide group

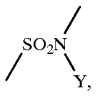

an ethyleneoxy group, or an amino group

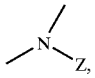

wherein substituents X, Y, and Z are each independently a hydrogen atom, or an alkyl group of 1–4 carbon atoms. One particularly suitable water-soluble polymeric acid is poly-aspartic acid.

In another embodiment of the invention the gelatin containing layer contains a water soluble polymeric acid and may or may not demonstrate the maximum swell effect described above. In this embodiment the water soluble polymeric acid and its preferred embodiments are the same as described above. It is particularly useful with this embodiment that the gel containing imaging or non-imaging layer is a layer above the imaging layer closest to the support which allows the developer to more easily diffuse to said imaging layer. The water soluble polymeric acids of this invention may be prepared by means known to those skilled in the art and are commercially available.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be bonded to the remainder of the molecule by an atom of carbon, silicon, oxygen, nitrogen, phosphorous, or sulfur. Suitable substituents for A include, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,-dit-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alphaor beta-naphthyloxy, and 4-tolyloxy; carbonamido, such as acetamido, benzamido, butyramido, tetradecanamido, alpha-(2,4-di-tpentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, Nmethyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenylN-p-toluylureido, N-(m-hexadecylphenyl)ureido, N,N-(2,5di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,Ndipropylsulfamoyl, N-hexadecylsulfamoyl, N,N-dimethylsulfamoyl; N-[3-(dodecyloxy)propyl]sulfamoyl, N-[4-(2,4di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy) butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-tpentylphenoxysulfonyl, methylsulfonyl, octylsulfonyl, 2-ethylhexylsulfonyl, dodecylsulfonyl, hexadecylsulfonyl, phenylsulfonyl, 4nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy. Preferred substituents are alkyl groups with 1 to 4 carbons.

The photographic emulsions of this invention are generally prepared by precipitating silver halide crystals in a colloidal matrix by methods conventional in the art. The colloid is typically a hydrophilic film formation agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is mixed with a melt containing dispersions of one or more color forming couplers and is coated on a support. The photographic elements of the invention can be prepared by any of a number of well-know coating techniques, such as dip coating, rod coating, blade coating, air knife coating, gravure coating and reverse roll coating, extrusion coating, slide coating, curtain coating, and the like. Known coating and drying methods are described in further detail in Research Disclosure No. 308119, Published Dec. 1989, pages 1007 to 1008.

The swell enhancing compounds may be added to the silver halide emulsion at any time during the preparation of the emulsion, i.e., during precipitation, during or before chemical sensitization or during final melting and co-mixing of the emulsion and additives for coating. If added to the emulsion dispersion, preferably these compounds are added after precipitation of the grains, and most preferably they are added after the heat treatment employed in the chemical sensitization step. It is particularly useful to add them during the final melting stage. The swell enhancing compounds may also be added to the melt which contains dispersions of one or more color formation couplers. These coupler dispersions are combined with the emulsion containing melt immediately prior to coating. The swell enhancing compound may be added to the aqueous gelatin used in the coupler dispersion preparation. More preferably the swell enhancing compound is added to the coupler dispersion melt after preparation of the dispersion but before mixing with the emulsion immediately prior to coating.

The swell enhancing compounds may be introduced into the emulsion or coupler dispersion melts at the appropriate time by any of the various techniques known to those skilled in the art. Preferably they are added as an aqueous solution to the melts after preparation of the emulsion or dispersion. Combinations of more than one swell enhancing compound may be utilized.

The silver halide emulsions utilized in this invention may be comprised of any halide distribution. Thus, they may be comprised of silver bromoiodide, silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. Preferably, the silver halide emulsions utilized in this invention are predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride. These emulsions may contain iodides or bromides or both as the remainder of the total halide composition.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred. Tetradecahedral grains with {111} and {100} crystal faces may also be utilized. The Au(I) compounds may also be used in reversal systems having core shell silver halide emulsions.

The multilayer, multicolor photographic elements of this invention typically contain dye image-forming layers sensitive to each of the three primary regions of the visible spectrum. Each layer can comprise a single emulsion layer or of multiple emulsion layers sensitive to a region of the spectrum. The layers of the element can be arranged in various orders as known in the art. A typical multicolor photographic element comprises a support bearing a yellow dye image-forming layer comprising at least one blue-sensitive silver halide emulsion layer having associated therewith at least one yellow dye-forming coupler, a magenta dye image-forming layer comprising at least one green-sensitive silver halide emulsion layer having associated therewith at least one magenta dye-forming coupler, and a red dye image-forming layer comprising at least one red-sensitive silver halide emulsion layer having associated therewith at least one cyan dye-forming coupler. The element typically contains additional layers, such as interlayers and overcoat layers. All of these can be coated on a support which can be transparent or reflective.

The photographic emulsions may be incorporated into color negative (particularly color paper) or reversal photographic elements. The photographic element may also comprise a transparent magnetic recording layer such as a layer containing magnetic particles on the underside of a transparent support, as described in Research Disclosure, November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in Research Disclosure, June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) Research Disclosure, December 1978, Item 17643, (2) Research Disclosure, December 1989, Item 308119, (3) Research Disclosure, September 1994, Item 36544, and (4) Research Disclosure, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention, particularly those describing high chloride color papers, are described in Research Disclosure, February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 & 4 | I, II, III, IX A & B | hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical |
| 2 | V | brighteners, luminescent |
| 3 & 4 | VI | dyes |
| 1 | VI | Antifoggants and |
| 2 | VI | stabilizers |
| 3 & 4 | VII | |
| 1 | VIII | Absorbing and scattering |
| 2 | VIII, XIII, XVI | materials; Antistatic layers; matting agents |
| 3 & 4 | VIII, IX C & D | |
| 1 | VII | Image-couplers and image- |
| 2 | VII | modifying couplers; Wash- |
| 3 & 4 | X | out couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as the electron beam, beta radiation, gamma radiation, X-ray, alpha particle, neutron radiation, and other forms of corpuscular and wave-like radiant energy in either noncoherent (random phase) forms or coherent (in phase) forms, as produced by lasers. When the photographic elements are intended to be exposed by X-rays, they can include features found in conventional radiographic elements. The photographic elements are preferably exposed to actinic radiation, typically in the visible region of the spectrum, to form a latent image, and then processed to form a visible dye image. Development is typically followed by the conventional steps of bleaching, fixing, or bleach-fixing, to remove silver or silver halide, washing, and drying.

The present invention will now be described in detail with reference to examples; however, the present invention should not limited by these examples.

EXAMPLES

Example 1

Sample 101

A silver halide color photographic light-sensitive material was coated on a polyethylene-coated paper support. The photographic element contained:

First layer (Blue sensitive imaging layer, closest to support)

1.31 g/m$^2$ gelatin 0.23 g/m$^2$ (as Ag) blue sensitized silver chloride emulsion 0.41 g/m$^2$ yellow dye forming coupler Y-1

Second layer (Interlayer)

0.75 g/m$^2$ gelatin 0.07 g/m$^2$ anti-color mixing agent D-1

Third layer (Green sensitive imaging layer)

1.42 g/m$^2$ gelatin 0.08 g/m$^2$ (as Ag) green sensitized silver chloride emulsion 0.24 g/m$^2$ magenta dye forming coupler M-1

Fourth layer (UV absorbing interlayer)

0.71 g/m$^2$ gelatin 0.17 g/m$^2$UV absorber UV-1

0.03 g/m$^2$ UV absorber UV-2

0.05 g/m$^2$ anti-color mixing agent D-1

Fifth layer (Red sensitive imaging layer)

1.36 g/m$^2$ gelatin 0.21 g/m$^2$ (as Ag) red sensitized silver chloride emulsion 0.38 g/m$^2$ cyan dye forming coupler C-1

Sixth layer (UV absorbing interlayer)

0.54 g/m$^2$ gelatin 0.13 g/m$^2$ UV absorber UV-1

0.02 g/m$^2$ UV absorber UV-1

0.04 g/m$^2$ anti-color mixing agent D-1

Seventh layer (Protective overcoat)

0.65 g/m$^2$ gelatin

Y-1

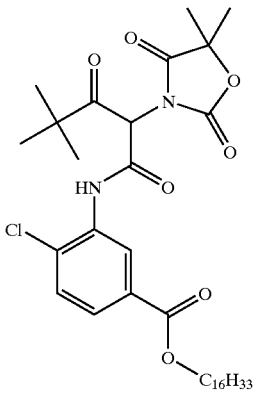

M-1

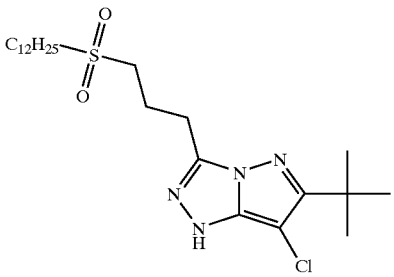

-continued

C-1

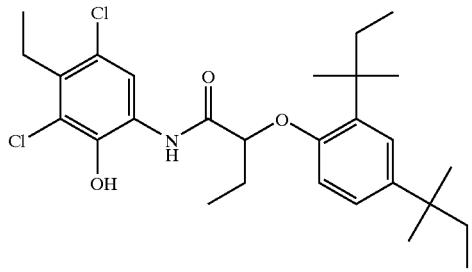

D-1

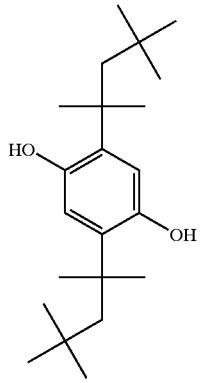

UV-1

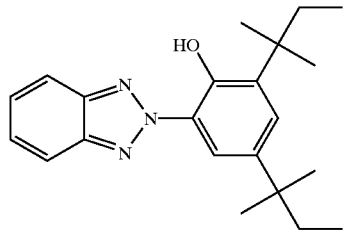

UV-2

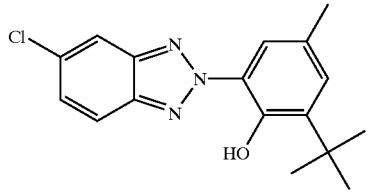

Samples 102 to 104

The polymeric additive-polyaspartic acid sodium salt (PAA-1, avg MW=3000 Da) is incorporated in different layers based on the multilayer structure given for Sample 101. An aqueous solution of the polymer was added to the gelatine containing melt. The incorporation scheme is summarized in Table 1.

TABLE 1

| Photographic Sample | Layers polyaspartic acid added |
|---|---|
| 101 | Check |
| 102 | 0.14 g/m$^2$ PAA-1 added to fifth layer |
| 103 | 0.14 g/m$^2$ PAA-1 added to third layer |
| 104 | 0.14 g/m$^2$ PAA-1 added to third layer<br>0.14 g/m$^2$ PAA-1 added to fifth layer |

The photographic elements were processed according to the following scheme. Development was carried out in Developer-1 at 35° C. for varied times, and Bleach/Fix was carried out in KODAK EKTA COLOR Prime Bleach/Fix at 35° C. for 45 seconds. The wash was carried out in water at 35° C. for 90 seconds

TABLE 2

Color paper developer formulation Developer-1.

| Developer Component | Concentration |
|---|---|
| Triethanolamine 100% | 5.5 mL |
| Versa ® TL-73 Lithium polystyrene sulfonate (30% w/w solution) | 0.15 mL |
| Potassium Sulfite (45%) | 0.5 mL |
| KODAK ® Balancing Developer Agent | 5.64 mL |
| BD-89 Diethylhydroxylamine (85% w/w solution) | |
| Blankophor ® REU 170 (Phorwite) | 0.82 g |
| Lithium Sulfate | 2.00 g |
| KODAK ® Anti-Calcium No. 5-1-hydroxyethylidene-1,1-diphosphonic acid (60% w/w solution) | 0.60 mL |
| Potassium Chloride | 5.72 g |
| Potassium Bromide | 0.024 g |
| KODAK ® Color Developing Agent, CD-3 | 4.27 g |
| Potassium Carbonate | 25.0 g |
| Water to make (adjust pH to 10.10) | 1 L |

Samples of each photographic element were given a neutral exposure and processed according to the above formula and sequences. For each of the coatings the shoulder density was measured at an exposure 0.4 logE higher than the exposure necessary to provide a density of 0.8. The yellow layer developability (DEV) is defined as the ratio of the Status A blue shoulder with development arrested at 30 seconds relative to the Status A blue shoulder density with 90 seconds development. (DEV=Density at 30 s/Density at 90s×100%)

The improvement in yellow developability on the addition of PAA-1 are given in Table 3.

TABLE 3

| Photographic Sample | DEV |
|---|---|
| 101 | 71.5 |
| 102 | 75.2 |
| 103 | 73.3 |
| 104 | 78 |

The data shows that the addition of PAA-1 to the photographic coating improved developability at shorter times of development, and thus provides more robustness to the process.

Example 2

Sample 201

A silver halide color photographic light-sensitive material was coated on a polyethylene-coated paper support. The photographic element contained First layer (Blue sensitive imaging layer, closest to support)

1.31 g/m$^2$ gelatin 0.23 g/m$^2$ (as Ag) blue sensitized silver chloride emulsion 0.41 g/m$^2$ yellow dye forming coupler Y-1

Second layer (Interlayer)

0.75 g/m$^2$ gelatin 0.07 g/m$^2$ anti-color mixing agent D-1

Third layer (Green senstive imaging layer)

1.38 g/m$^2$ gelatin 0.08 g/m$^2$ (as Ag) green sensitized silver chloride emulsion 0.22 g/m$^2$ magenta dye forming coupler M-1

Fourth layer (UV absorbing interlayer)

0.71 g/m$^2$ gelatin 0.17 g/m$^2$ V absorber UV-1

0.03 g/m$^2$ UV absorber UV-2

0.05 g/m$^2$ anti-color mixing agent D-1

Fifth layer (Red senstive imaging layer)

1.36 g/m$^2$ gelatin 0.21 g/m$^2$ (as Ag) red sensitized silver chloride emulsion 0.38 g/m$^2$ cyan dye forming coupler C-1

Sixth layer (UV absorbing interlayer)

0.54 g/m$^2$ gelatin 0.13 g/m$^2$ UV absorber UV-1

0.02 g/m$^2$ UV absorber UV-1

0.04 g/m$^2$ anti-color mixing agent D-1

Seventh layer (Protective overcoat)

0.65 g/m$^2$ gelatin

The scheme of incorporation of PAA-1 into Sample 202 to 204 is given in Table 4.

TABLE 4

| Photographic Sample. | Layers polyaspartic acid added |
|---|---|
| 201 | Check |
| 202 | 0.14 g/m$^2$ PAA-1 added to third layer |
| | 0.14 g/m$^2$ PAA-1 added to fifth layer |
| 203 | 0.08 g/m$^2$ PAA-1 added to second layer |
| | 0.14 g/m$^2$ PAA-1 added to third layer |
| | 0.07 g/m$^2$ PAA-1 added to fourth layer |
| | 0.14 g/m$^2$ PAA-1 added to fifth layer |
| | 0.05 g/m$^2$ PAA-1 added to sixth layer |
| 204 | 0.08 g/m$^2$ PAA-1 added to second layer |
| | 0.14 g/m$^2$ PAA-1 added to third layer |
| | 0.07 g/m$^2$ PAA-1 added to fourth layer |
| | 0.14 g/m$^2$ PAA-1 added to fifth layer |
| | 0.05 g/m$^2$ PAA-1 added to sixth layer |
| | 0.06 g/m$^2$ PAA-1 added to seventh layer |

The improvements in yellow developability from addition of PAA-in Table 5

TABLE 5

| Photographic Sample. | DEV |
|---|---|
| 201 | 71 |
| 202 | 78 |
| 203 | 80 |
| 204 | 80 |

The data shows that the addition of PAA-1 to the photographic coating improved developability at shorter times of development. As such, it renders a much robust paper through the RA-4 development.

Example 3

The coatings from Example 2 were processed through a rapid development formulation according to the following scheme. Development was carried out in Developer 2 at 40° C. for 25 seconds; Bleach/Fix was carried out in KODAK EKTA COLOR Prime Bleach/Fix at 40° C. for 25 seconds and washing was in water at 40° C. for 90 seconds.

TABLE 6

Color paper developer formulation for Developer 2

| Developer Component | Concentration |
|---|---|
| Triethanolamine (85%) | 3.27 mL |
| KODAK ® Balancing Developer Agent | 4.46 mL |
| BD-89 Diethylhydroxylamine (85% w/w solution) | |
| Blankophor ® REU 170 (Phorwite) | 0.81 g |
| Versa ® TL-73 Lithium polystyrene sulfonate (30% w/w solution) | 0.13 mL |
| KODAK ® Anti-Calcium No. 5-1-hydroxyethylidene-1,1-diphosphonic acid (60% w/w solution) | 0.56 mL |
| Potassium carbonate (47%) | 41.6 mL |
| Potassium Hydroxide 45% | 0.48 mL |
| Potassium Chloride | 4.46 g |
| Potassium Bromide | 0.21 g |
| KODAK ® Color Developing Agent, CD-3 | 5.32 g |
| Lihtium sulfate | 1.56 g |
| Potassium sulfite (45%) | 0.65 g |
| Water to make pH adjusted to 10.3) | 1 L |

The developability improvement for the rapid process is measured as the increase in blue shoulder density change on addition of PAA-1 relative to the check. The yellow layer developability results from the rapid process are summarized in Table 7

TABLE 7

| Photographic Sample | Shoulder Density Improvement |
|---|---|
| 201 | 0 |
| 202 | 0.1 |
| 203 | 0.12 |
| 204 | 0.12 |

the data in Table 7 show the presence of PAA-1 increases upper scale densities in a rapid color development process.

Example 4

Samples 201 to 204 were also processed through a rapid development formulation using Developer-3.

TABLE 8

Color paper developer formulation for Developer 3

| Developer Component | Concentration |
|---|---|
| N,N-bis(2,3-dihydroxypropyl)hydroxylamine | 3 g |
| Sodium salt of p-toluene sulfonic acid | 13 g |
| Blankophor ® REU 170 (Phorwite) | 2 g |
| KODAK ® Anitcal #8 (40%) | 9.6 mL |
| Potassium carbonate | 33 g |
| Potassium Chloride | 2.5 g |
| KODAK ® Color Developing Agent, CD-3 | 8 g |
| Water to make pH adjusted to 10.6) | 1 L |

Development was carried out in Developer 3 at 42° C. for 14 seconds, and Bleach/Fix was carried out in KODAK EKTACOLOR Prime Bleach/Fix at 42° C. for 45 seconds. Washing was in water at 42° C. for 120 seconds.

The developability improvement for the 14 seconds rapid process is measured as the increase in red, green and blue shoulder density change on addition of PAA-1 relative to the check. The developability results from the rapid process Developer 3 are summarized in Table 9.

TABLE 9

| Photographic Sample | Red Shoulder Density Improvement | Green Shoulder Density Improvement | Blue Shoulder Density Improvement |
|---|---|---|---|
| 201 | 0 | 0 | 0 |
| 202 | 0.092 | 0.046 | 0.121 |
| 203 | 0.165 | 0.075 | 0.139 |
| 204 | 0.141 | 0.089 | 0.142 |

The photographic elements prepared in accordance with the present invention have showed improved robustness in regular conventional development conditions, and much improved developability in both 25 seconds and 14 seconds rapid development processes.

Example 5

The impact of poly aspartic acid on film swell was evaluated by coating photographic gelatin with various percentage of poly aspartic acid (this invention) and poly sulfonic acid or poly acrylic acid as comparative examples. These coatings were swelled into pH 10.10 carbonate buffer solution and the equilibrium swell and maximum swell values were obtained from each swell curve as shown in Table 1

TABLE 10

Coating scheme and swell parameters with 21.52 g/m$^2$ total gelatin laydown

| Photographic Sample | Polymer | Polymer laydown relative to total gelatin laydown | Equilibrium Swell ($\mu$m) | Maximum Swell ($\mu$m) | Comments |
|---|---|---|---|---|---|
| 301 | 0 | 0 | 39.1 | 39.1 | control |
| 302 | poly aspartic acid | 10% | 38.7 | 40.1 | invention |
| 303 | poly aspartic acid | 20% | 39.4 | 43.1 | invention |
| 304 | poly sulfonic acid | 10% | 43.6 | 43.6 | comparative |
| 305 | poly sulfonic acid | 20% | 41.5 | 41.5 | comparative |
| 306 | poly acrylic acid | 10% | 40.0 | 40.4 | comparative |
| 307 | poly acrylic acid | 20% | 48.3 | 48.3 | comparative |

The swell values at different time of swell were normalized against equilibrium swell and a delta swell-ΔS, was defined from normalized swell as follows:

$$\Delta S = (\text{Normalized swell value at any time t}) - (\text{Normalized swell value at equilibrium})$$

It can be seen clearly from FIG. 1 that incorporation of poly aspartic acid results in a maximum swell value that is greater than equilibrium swell value. However, neither control sample nor comparative samples have similar swelling characteristics.

The invention has been described in detail with particular reference to preferred embodiments thereof, but it will be understood that variations and modifications can be effected within the scope and spirit of the invention.

What is claimed is:

1. A silver halide photographic element comprising a support and at least one gelatin containing imaging or non-imaging layer wherein during chemical processing the maximum swell of the layer is greater than the equilibrium swell.

2. The silver halide photographic element of claim 1 wherein the at least one imaging or non-imaging layer is a layer above the imaging layer closest to the support.

3. The silver halide photographic element of claim 1 wherein the layer contains a swell enhancing compound which will wash out during chemical processing.

4. The silver halide photographic element of claim 3 wherein the swell enhancing compound is a water-soluble polymeric acid.

5. The silver halide photographic element of claim 4 wherein the

Formula I

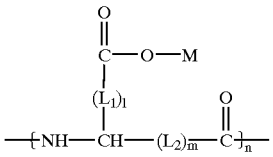

wherein M is H or a metal cation, n is greater than 10, and $L_1$ and $L_2$ are independently divalent linking groups, and m and l are independently 0 or 1.

6. The silver halide photographic element of claim 5 wherein $L_1$ and $L_2$ are independently one or more of a carbon atom, an oxygen atom, a sulfur atom, a carbonyl group

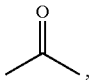

a carboxylic ester group

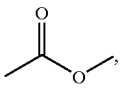

a carboxylic amide group

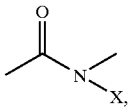

a sulfonyl group

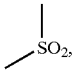

a sulfonamide group

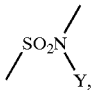

an ethyleneoxy group, or an amino group

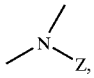

wherein substituents X, Y, and Z are each independently a hydrogen atom, or an alkyl group of 1–4 carbon atoms.

7. The silver halide photographic element of claim 5 wherein the water-soluble polymeric acid is poly-aspartic acid.

8. The silver halide photographic element of claim 5 wherein the water-soluble polymeric acid has a molecular weight of 500 to 15000 Daltons.

9. The silver halide photographic element of claim 7 wherein the water-soluble polymeric acid has a molecular weight of 500 to 15000 Daltons.

10. The silver halide photographic element of claim 4 wherein the water soluble polymeric acid is contained in the layer in an amount of 5% to 20% of the gelatin in the layer.

11. A silver halide photographic element comprising a support and at least one gelatin containing imaging or non-imaging layer, said layer being located above the imaging layer closest to the support, wherein during chemical processing the maximum swell of the layer is greater than the equilibrium swell and the layer comprises a water-soluble polymeric acid represented by the Formula:

Formula I

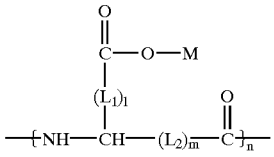

wherein M is H or a metal cation, n is greater than 10, and $L_1$ and $L_2$ are independently divalent linking groups, and m and 1 are independently 0 or 1; and wherein the water-soluble polymeric acid has a molecular weight of 500 to 15000 Daltons.

12. The silver halide photographic element of claim 11 wherein the water soluble polymeric acid is contained in the layer in an amount of 5% to 20% of the gelatin in the layer.

13. The silver halide photographic element of claim 11 wherein the water-soluble polymeric acid is poly-aspartic acid.

14. The silver halide photographic element of claim 11 wherein the silver halide photographic element contains at least one silver halide emulsion in which the grains of the emulsion are greater than 50 mole percent silver chloride.

15. A silver halide photographic element comprising a support and at least one gelatin containing imaging or non-imaging layer containing a water-soluble polymeric acid represented by the formula Formula I

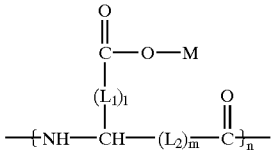

wherein M is H or a metal cation, n is greater than 10, and $L_1$ and $L_2$ are divalent linking groups, and m and are independently 0 or 1.

16. The silver halide photographic element of claim 15 wherein $L_1$ and $L_2$ are independently one or more of a carbon atom, an oxygen atom, a sulfur atom, a carbonyl group

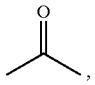

a carboxylic ester group

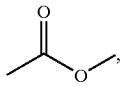

a carboxylic amide group

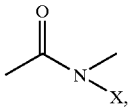

a sulfonyl group

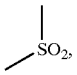

a sulfonamide group

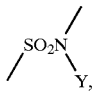

an ethyleneoxy group, or an amino group

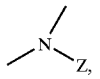

wherein substituents X, Y, and Z are each independently a hydrogen atom, or an alkyl group of 1–4 carbon atoms.

17. The silver halide photographic element of claim 15 wherein the water-soluble polymeric acid is poly-aspartic acid.

18. The silver halide photographic element of claim 15 wherein the water-soluble polymeric acid has a molecular weight of 500 to 15000 Daltons.

19. The silver halide photographic element of claim 17 wherein the water-soluble polymeric acid has a molecular weight of 500 to 15000 Daltons.

20. The silver halide photographic element of claim 15 wherein the water soluble polymeric acid is contained in the layer in an amount of 5% to 20% of the gelatin in the layer.

21. The silver halide photographic element of claim 15 wherein the silver halide photographic element contains at least one silver halide emulsion in which the grains of the emulsion are greater than 50 mole percent silver chloride.

* * * * *